US007634925B2

(12) United States Patent
Lim et al.

(10) Patent No.: US 7,634,925 B2
(45) Date of Patent: Dec. 22, 2009

(54) WASHING AND DRYING MACHINE

(75) Inventors: Hee Tae Lim, Kyungki-do (KR); Sang Wook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 503 days.

(21) Appl. No.: 11/397,675

(22) Filed: Apr. 5, 2006

(65) Prior Publication Data

US 2006/0225467 A1 Oct. 12, 2006

(30) Foreign Application Priority Data

Apr. 6, 2005 (KR) ..... 10-2005-0028483

(51) Int. Cl.
*D06F 25/00* (2006.01)
*D06F 29/00* (2006.01)

(52) U.S. Cl. ..... 68/20; 68/142

(58) Field of Classification Search ..... 68/19.2, 68/20, 140, 142, 207
See application file for complete search history.

(56) References Cited

U.S. PATENT DOCUMENTS

| | | | | |
|---|---|---|---|---|
| 2,644,245 | A * | 7/1953 | Hammell et al. | 34/547 |
| 2,717,456 | A * | 9/1955 | Smith | 34/75 |
| 4,024,735 | A * | 5/1977 | Marchiselli | 68/16 |
| 4,112,590 | A * | 9/1978 | Muller | 34/75 |
| 6,282,928 | B1 | 9/2001 | Fukumoto et al. | |
| 6,378,342 | B1 * | 4/2002 | Fukumoto et al. | 68/20 |
| 6,665,953 | B2 * | 12/2003 | Woo et al. | 34/527 |
| 7,415,848 | B2 * | 8/2008 | Jeong et al. | 68/18 C |
| 2005/0223503 | A1 | 10/2005 | Hong et al. | |
| 2006/0096114 | A1 | 5/2006 | Hong et al. | |
| 2006/0101587 | A1 | 5/2006 | Hong et al. | |

FOREIGN PATENT DOCUMENTS

| | | |
|---|---|---|
| DE | 1610090 | 4/1971 |
| DE | 2605048 | 8/1977 |
| EP | 0942093 | 9/1999 |
| JP | 2-241486 | 9/1990 |
| KR | 1999-003656 | 1/1999 |
| KR | 10-0272135 | 8/2000 |
| WO | 93/17169 | 9/1993 |

OTHER PUBLICATIONS

Electronic translation of DE 1610090.*
Electronic translation of DE 1610090, date not applicable.*
English Language Abstract of JP 2-241486.
English Language Abstract of KR1999-003656.
English Language Abstract of KR 10-0272135.
U.S. Appl. No. 11/397,676 to Hong, filed Apr. 5, 2006.

* cited by examiner

*Primary Examiner*—Joseph L Perrin
(74) *Attorney, Agent, or Firm*—Birch, Stewart, Kolasch & Birch, LLP

(57) ABSTRACT

A washing and drying machine that is capable of performing heat exchange between outside air introduced into a cabinet and the circumferential surface of a tub so as to condense air used to dry laundry. No cooling water is used to condense air used to dry the laundry. Consumption of water is reduced, and therefore, the maintenance costs of the washing and drying machine are decreased. Furthermore, no condensing duct is necessary. Consequently, flow resistance is decreased, and drying efficiency is improved. In addition, sufficient space is provided between the rear surface of the tub and the cabinet. Consequently, the volume of the drum is increased, and the washing/drying capacity of the washing and drying machine is increased.

11 Claims, 6 Drawing Sheets

WASHING AND DRYING MACHINE

CROSS-REFERENCE TO RELATED APPLICATIONS

The present disclosure relates to subject matter contained in priority Korean Application No. 2005-28483, filed on Apr. 6, 2005, which is herein expressly incorporated by reference in its entirety.

BACKGROUND OF THE INVENTION

1. Field of the Invention

The present invention relates to a washing and drying machine, and, more particularly, to a washing and drying machine that is capable of performing heat exchange between outside air introduced into a cabinet and the circumferential surface of a tub so as to condense air used to dry laundry, thereby minimizing flow resistance, improving drying efficiency, and reducing maintenance costs.

2. Description of the Related Art

Generally, a washing machine is a machine that is capable of removing pollutants from clothes or bedclothes (hereinafter, referred to as "laundry") with detergent-dissolved water or pure water (hereinafter, referred to as "washing water"). Recently, a large number of washing machines have incorporated a drying unit for drying the laundry, and therefore, each washing machine has a drying function.

FIG. 1 is a longitudinal sectional view illustrating the interior of a conventional washing and drying machine.

As shown in FIG. 1, the conventional washing and drying machine comprises: a cabinet 2 forming the exterior of the washing machine; a tub 10 mounted in the cabinet 2 for receiving washing water; a drum 20 rotatably disposed in the tub 10 for receiving laundry 1; and a motor 30 for rotating the drum 20.

At the front surface of the cabinet 2 is formed a laundry inlet/outlet hole 3, through which the laundry 1 is put into the drum 20 and removed from the drum 20. The laundry inlet/outlet hole 3 is opened or closed by a door 4.

The tub 10 is mounted in the cabinet while being suspended by springs 5 connected between the upper end of the cabinet 2 and the tub 10. Also, the tub 10 is supported by a damper 6 disposed at the lower end of the cabinet 2 such that shock applied to the tub 10 is effectively absorbed by the damper 6.

To the tub 10 is connected a water supply unit 7 for supplying washing water into the tub 10 from the outside of the washing machine. To the tub 10 is also connected a drainage unit 8 for draining the washing water out of the tub 10.

At the center part of the front surface of the tub 10 is formed a tub opening hole 11, through which the laundry 1 and air are introduced into or discharged from the tub 10. To the front surface of the tub 10 is attached a gasket 9, which comes into tight contact with the door 4, when the door 4 is closed, for preventing the laundry 1, the washing water, and the air from being discharged from a gap between the tub 10 and the door 4.

At the inner bottom surface of the tub 10 is mounted a washing heater 13 for heating the washing water such that the laundry can be washed with hot water. At the inner bottom surface of the tub 10 is also mounted a washing temperature sensor (not shown) for detecting the temperature of the washing water.

At the front surface of the drum 20 is formed a drum opening hole 21, through which the laundry 1 and air are introduced into or discharged from the drum 20. At the circumferential surface of the drum 20 are formed a plurality of through-holes 22, through which washing water and air are introduced into or discharged from the drum 20.

To inner wall of the drum 20 are attached lifters 23, by which the laundry 1 is lifted and then falls.

The washing and drying machine further comprises: a drying duct 40, having a circulating fan 41 and a drying heater 42, for supplying hot air into the drum 20; and a condenser 43 for condensing wet air generated when the drum 20 is dried and guiding the condensed air to the drying duct 40.

In the drying duct 40 is mounted a fan motor 44 for rotating the circulating fan 41. The outlet end of the drying duct 40 is fixedly inserted into or fitted onto a drying duct connection member 12, which is formed at the gasket 9.

The condenser 43 comprises: a condensing duct 45 connected to the rear part of the tub 10 for allowing air to pass therethrough; and a cooling water supply unit 46 for supplying cooling water into the condensing duct 45 such that the air passing through the condensing duct 45 is cooled by the cooling water and thus condensed.

The inlet end of the condensing duct 45 is diagonally opposite to the outlet end of the drying duct 40 such that dry air introduced into the tub 10 from the drying duct 40 is uniformly circulated in the tub 10, and is then discharged into the condensing duct 45.

Specifically, the outlet end of the drying duct 40 is connected to the front upper part of the tub 10 while the inlet end of the condensing duct 45 is connected to the rear lower part of the tub 10.

In the condensing duct 45 is mounted a condenser temperature sensor 47 for detecting the temperature of air cooled by the cooling water.

The operation of the conventional washing and drying machine with the above-stated construction will now be described.

When a user puts the laundry 1 into the drum 20, closes the door 4, and operates the washing machine, washing water is introduced into the cabinet 2 through the water supply unit 7.

The introduced washing water is supplied into the tub 10, and is then introduced into the drum 20 through the drum opening hole 21 or the through-holes 22 such that the laundry 1 is wetted by the washing water.

As the motor 30 is operated, the drum 20 is rotated, and as a result, pollutants are separated from the laundry 1 by the washing water.

After the above-described washing process is completed, the pollutant contaminated washing water is drained out of the tub 10 through the drainage unit 8. Subsequently, a rinsing process for rinsing bubbles from the laundry 1 is performed several times.

After the rinsing processes are completed, a water removing or spinning process is performed to remove moisture from the laundry 1 by centrifugal force.

After the water removal process is completed, a drying process for drying the laundry 1 is performed. The drum 20 is rotated by the motor 30, and the circulating fan 41 and the drying heater 42 are turned on. Also, the cooling water is supplied into the condensing duct 45 through the cooling water supply unit 46.

As the circulating fan 41 is rotated, low-temperature and high-humidity air in the drum 20 is introduced into the condensing duct 45 through the through-holes 22 of the drum 20 and the tub 10.

At this time, the cooling water supplied through the cooling water supply unit 46 falls into the condensing duct 45, and the moisture in the air introduced into the condensing duct 45 is condensed by the cooling water. As a result, the air is dried.

After the air passes through the condensing duct 45, the air passes through the drying duct 40. At this time, the air is heated by the heater 42, and as a result, the air is changed into hot air. The hot air is blown to the front surface of the drum 20 through the outlet end of the drying duct 40.

The laundry 1 is dried in the drum 20 by the blown hot air, and as a result, the hot air is changed into low-temperature and high-humidity air, which flows into the condensing duct 45.

In the conventional washing and drying machine with the above-state construction, however, it is necessary that the condensing duct 45 be relatively long so as to sufficiently condense moisture contained in the air passing through the condensing duct 45. As a result, flow resistance is large, and the capacities of the tub 10 and the drum 20 are relatively decreased. Furthermore, a great amount of cooling water is consumed to cool the condensing duct 45, and therefore, the maintenance costs of the conventional washing and drying machine are increased.

SUMMARY OF THE INVENTION

The present invention is provided in view of the above problems, and it is an object of the present invention to provide a washing and drying machine that is capable of condensing air used to dry laundry with outside air without use of cooling water, thereby minimizing flow resistance, improving drying efficiency, and reducing maintenance costs.

In accordance with the present invention, the above and other objects can be accomplished by the provision of a washing and drying machine including: a tub disposed in a cabinet in a suspended fashion; a drum rotatably disposed inside the tub; a drying duct, having a drying heater and a circulating fan, for supplying hot air into the drum to dry laundry; and an air-cooling type condensing unit for performing heat exchange between air introduced from the outside of the cabinet and the circumferential surface of the tub to condense air used to dry the laundry in the drum.

Preferably, the air-cooling type condensing unit includes: an inlet port formed at one side of the cabinet for allowing outside air to be introduced into the cabinet therethrough; and an outlet port formed at the other side of the cabinet for allowing the outside air, which has exchanged heat with the circumferential surface of the tub, to be discharged out of the cabinet therethrough.

Preferably, the air-cooling type condensing unit further includes: an introduction channel for guiding the outside air introduced through the inlet port into the tub; a condensing channel for performing heat exchange between the outside air introduced into the tub through the introduction channel and the inner circumferential surface of the tub to condense air used to dry the laundry; and a discharge channel for guiding the heat-exchanged air such that the air is discharged out of the cabinet through the outlet port.

Preferably, the air-cooling type condensing unit further includes: a condensing plate mounted in the condensing channel for facilitating heat exchange between the outside air and the inner circumferential surface of the tub.

Preferably, the condensing plate is spaced a predetermined distance from the inner circumferential surface of the tub such that the outside air can flow along the inner wall of the tub.

Preferably, the air-cooling type condensing unit further includes: a blowing fan mounted in the introduction channel.

Preferably, the air-cooling type condensing unit further includes: a condensing channel defined by the inside surface of the cabinet and the outer circumferential surface of the tub for allowing the outside air introduced through the inlet port to flow between the outer circumferential surface of the tub and the inside surface of the cabinet and then guiding the air such that the air is discharged out of the cabinet through the outlet port.

Preferably, the air-cooling type condensing unit further includes: a condensing plate mounted at the circumferential surface of the tub for facilitating heat exchange between the outside air and the circumferential surface of the tub.

Preferably, the air-cooling type condensing unit further includes: a blowing fan mounted at the inlet port.

Preferably, the condensing plate is made of metal, and is embossed.

According to the present invention, the outside air exchanges heat with the circumferential surface of the tub to condense air used to dry the laundry. As a result, no cooling water is used to condense air used to dry the laundry. Consequently, the present invention has the effect of reducing consumption of water, and therefore, decreasing the maintenance costs of the washing and drying machine.

Furthermore, no condensing duct is necessary. Consequently, flow resistance is decreased, and therefore, drying efficiency is improved. In addition, sufficient space is provided between the rear surface of the tub and the cabinet. Consequently, the present invention has the effect of increasing the volume of the drum, and therefore, increasing the washing/drying capacity of the washing and drying machine.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention, the description is taken with the drawings making apparent to those skilled in the art how the forms of the present invention may be embodied in practice.

Now, preferred embodiments of the present invention will be described in detail with reference to the accompanying drawings.

Figure 1:
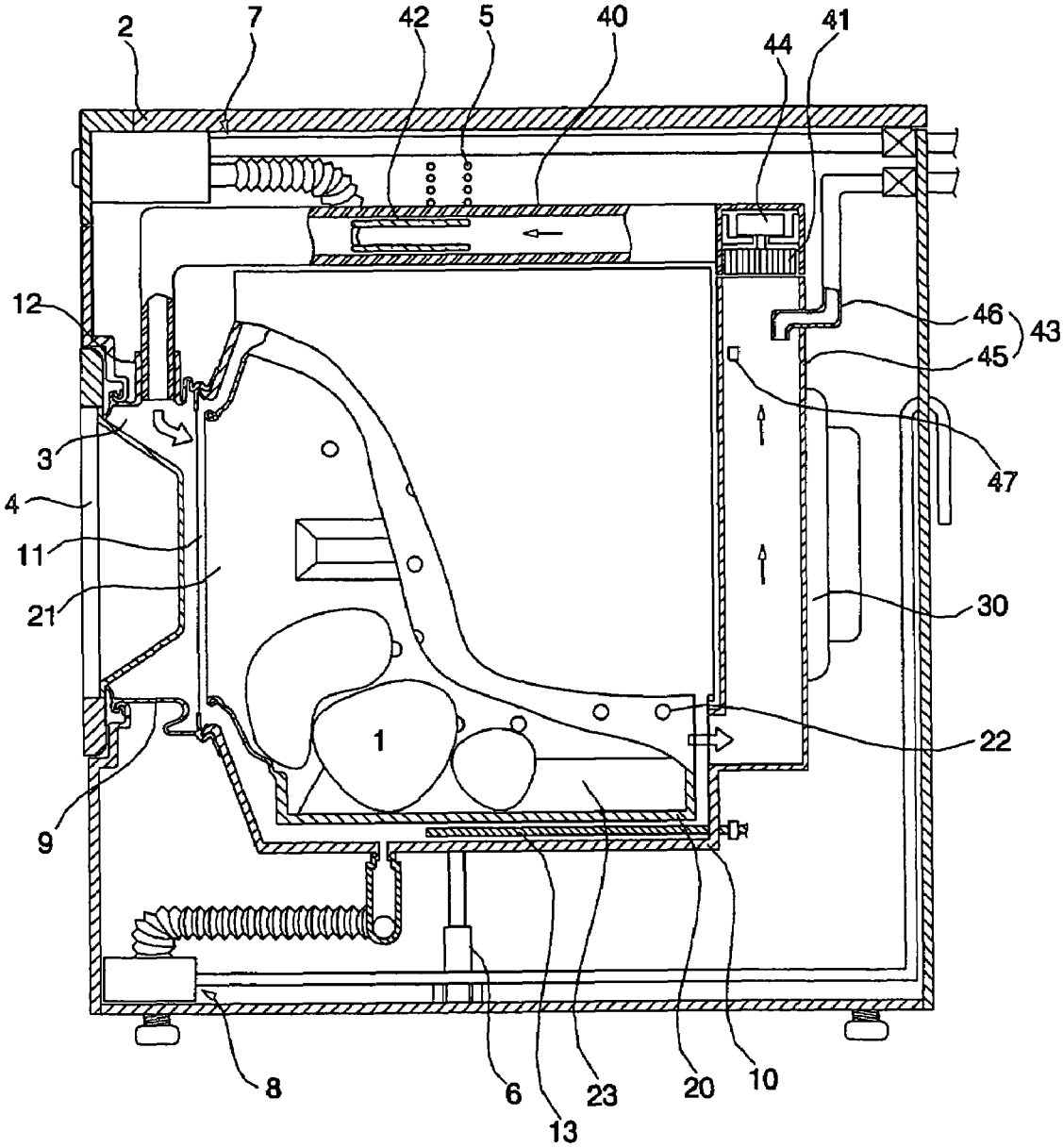
FIG. 1 (Prior Art)
FIG. 1 is a longitudinal sectional view illustrating a conventional washing and drying machine.
Figure 2:
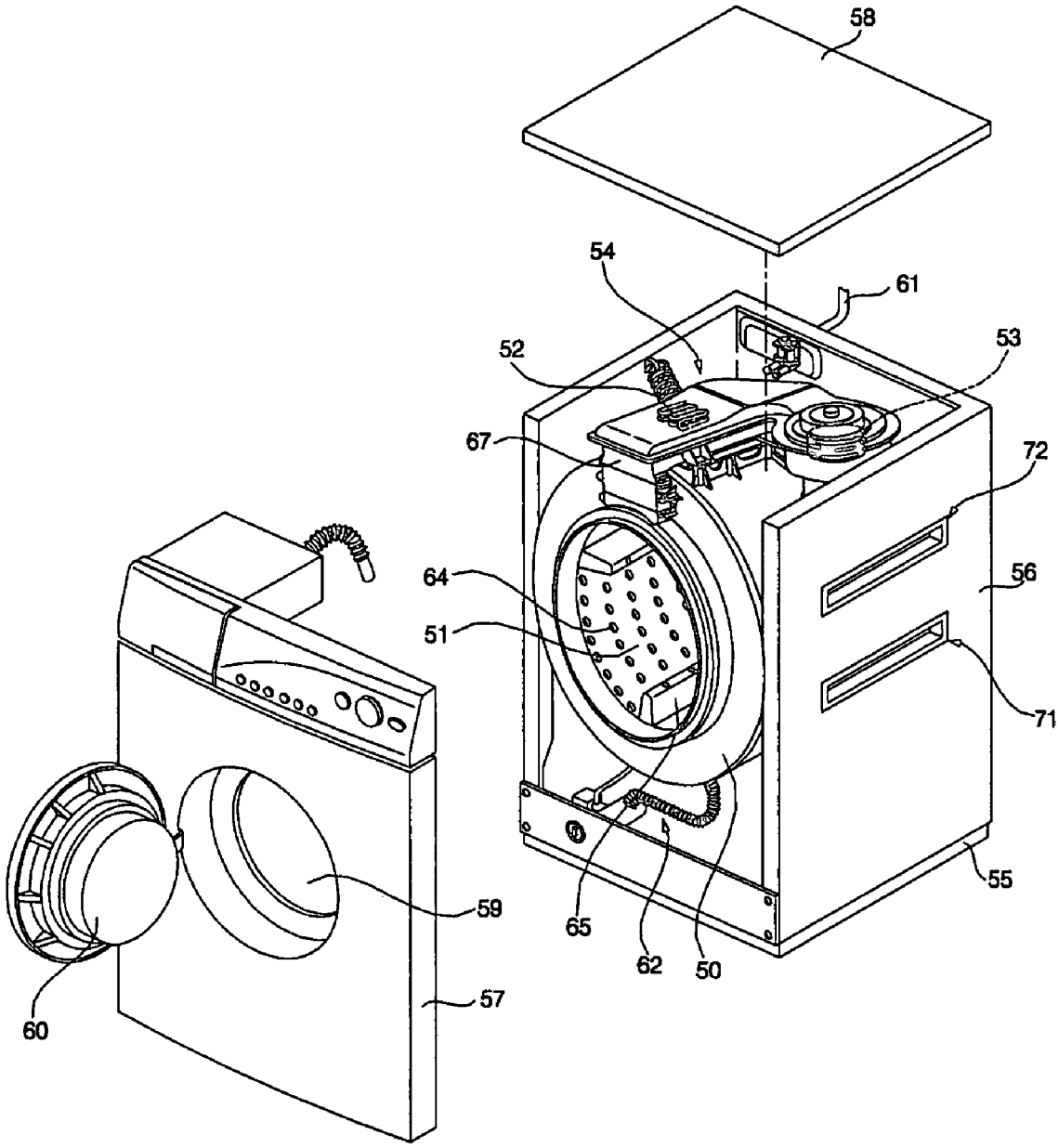
FIG. 2 is an exploded perspective view illustrating a washing and drying machine according to a first embodiment of the present invention.
Figure 3:
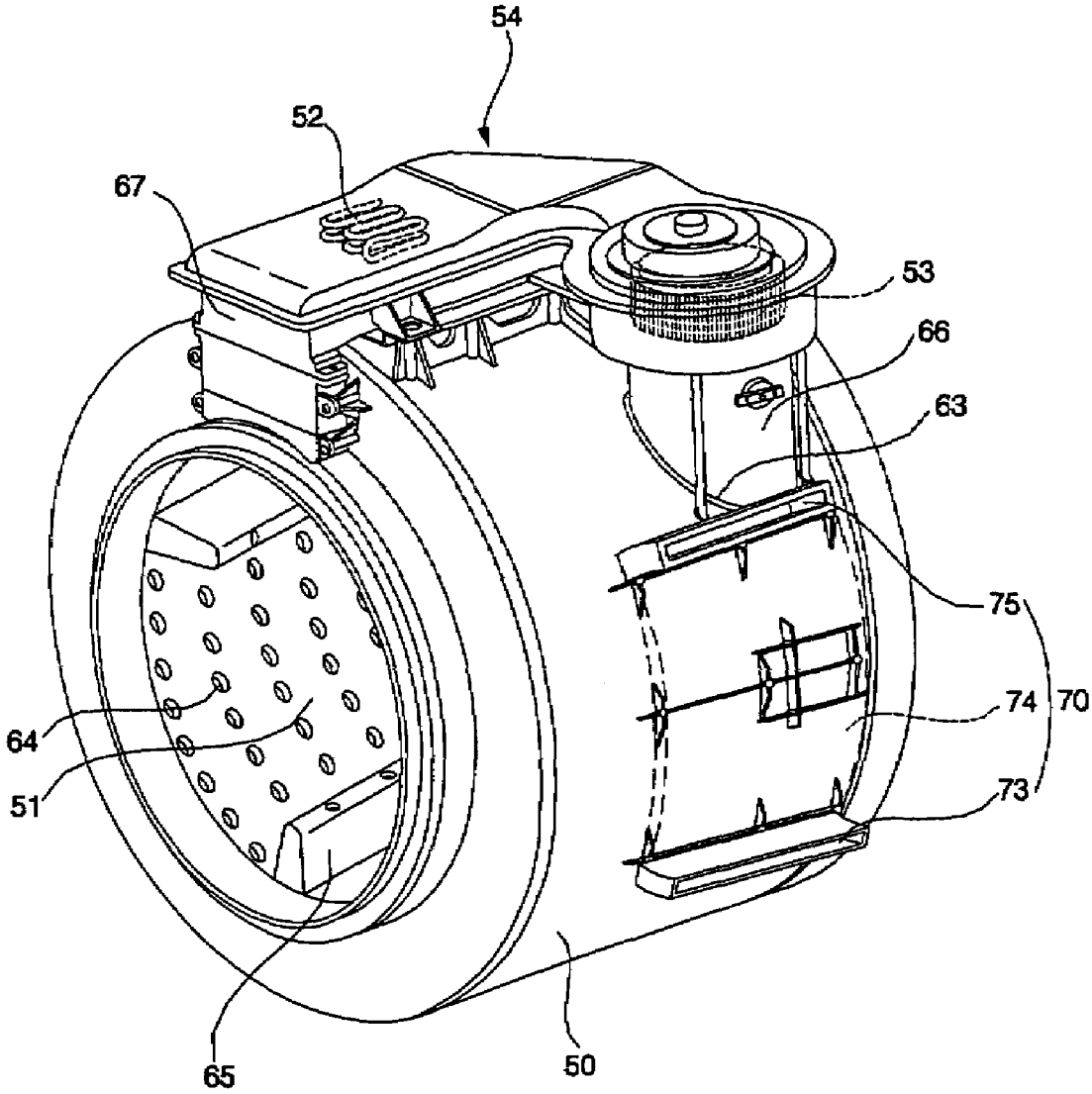
FIG. 3 is a perspective view illustrating a tub of the washing and drying machine according to the first embodiment of the present invention.
Figure 4:
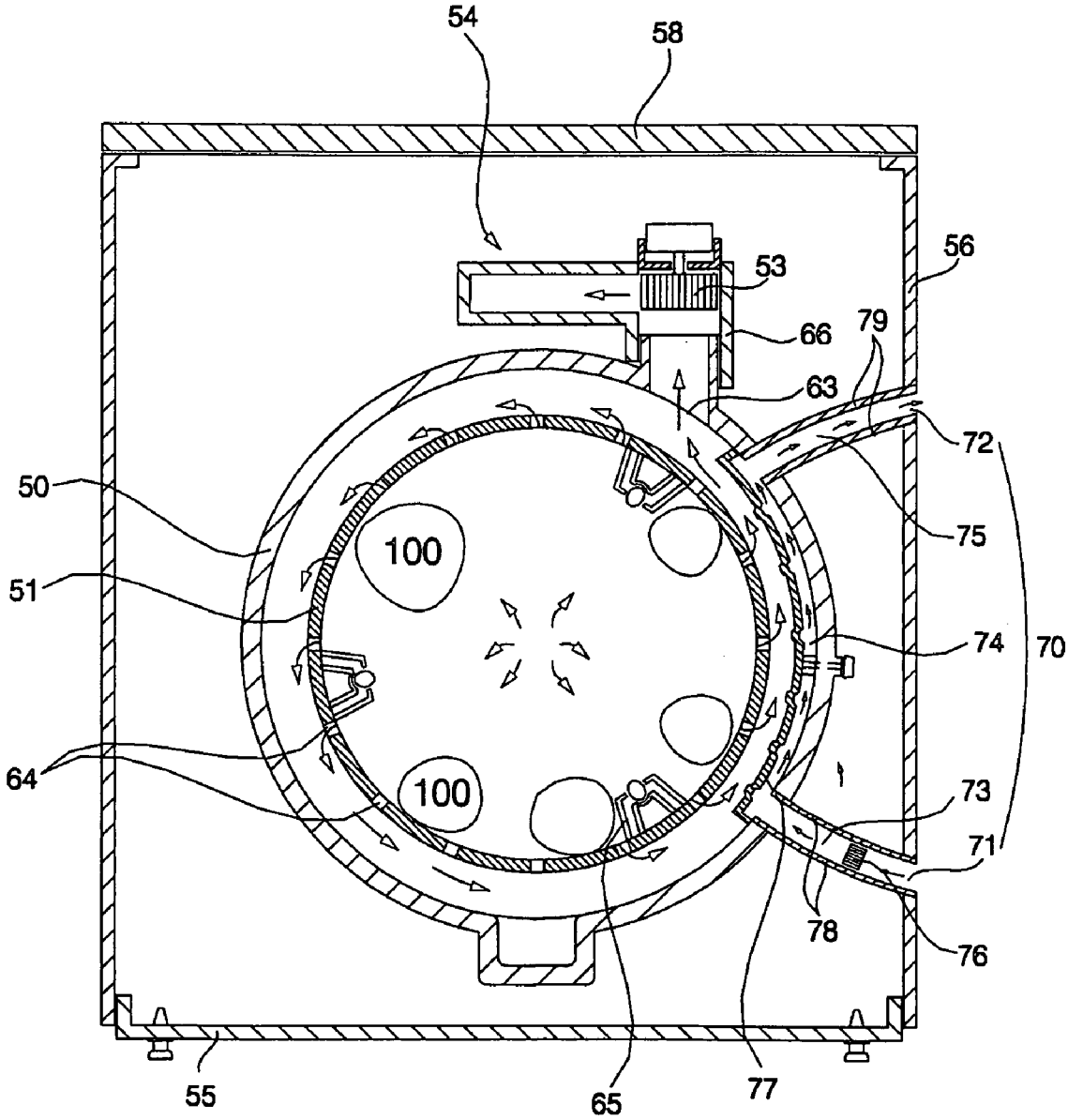
FIG. 4 is a cross-sectional view of the washing and drying machine according to the first embodiment of the present invention.

FIG. 2 is an exploded perspective view illustrating a washing and drying machine according to a first embodiment of the present invention, FIG. 3 is a perspective view illustrating a tub of the washing and drying machine according to the first embodiment of the present invention, and FIG. 4 is a cross-sectional view of the washing and drying machine according to the first embodiment of the present invention.

As shown in FIGS. 2 to 4, the washing and drying machine according to the first embodiment of the present invention includes: a tub 50 provided in a cabinet in a suspended manner; a drum 51 rotatably disposed inside the tub 50; a drying duct 54, having a drying heater 52 and a circulating fan 53, for supplying hot air into the drum 51 to dry laundry 100; and an air-cooling type condensing unit 70 for performing heat exchange between air introduced from the outside of the cabinet and the circumferential surface of the tub 50 to condense air used to dry the laundry 100 in the drum 51.

The cabinet includes: a base pan 55; a cabinet body 56 mounted on the base pan 55; a cabinet cover 57 disposed in the front of the cabinet body 56; and a top plate 58 mounted on the cabinet body 56 and the cabinet cover 57.

At the cabinet cover 57 is formed a laundry inlet/outlet hole 59, through which the laundry 100 is placed into or removed from the drum 51. To the cabinet cover 57 is also pivotably attached a door 60 for opening or closing the laundry inlet/outlet hole 59.

To the tub 50 is connected a water supply unit 61 for supplying washing water into the tub 50 from the outside of the washing machine. To the tub 50 is also connected a drainage unit 62 for draining the washing water out of the tub 50.

At the center portion of the front surface of the tub 50 is formed a tub opening hole, through which the laundry 100 and air are introduced into or discharged from the tub 50. To the front surface of the tub 50 is attached a gasket (not shown), which comes into tight contact with the door 60, when the door 60 is closed, for preventing the laundry 100, the washing water, and the air from being discharged from a gap between the tub 50 and the door 60.

At the upper part of the circumferential surface of the tub 50 is formed a duct communication port 63, to which the drying duct 54 is connected.

At the front surface of the drum 51 is formed a drum opening hole, through which the laundry 100 and air are introduced into or discharged from the drum 51. At the circumferential surface and the rear surface of the drum 51 are formed a plurality of through-holes 64, through which washing water and air are introduced into or discharged from the drum 51.

To the inner wall of the drum 51 are attached lifters 65, by which the laundry 100 is lifted and then falls.

The drying duct 54 includes: an introduction portion 66 for introducing air used to dry the laundry 100 in the drum 51; and a discharge portion 67 for heating the air introduced through the introduction portion 66 and discharging the heated air into the drum 51.

The introduction portion 66 is connected to the duct communication port 63. The discharge portion 67 is directly connected to the front surface of the tub 50 in the present embodiment. Alternatively, the discharge portion 67 may be connected to the gasket (not shown).

The air-cooling type condensing unit 70 includes: an inlet port 71 formed at one side of the cabinet body 56 for allowing outside air to be introduced into the cabinet therethrough; and an outlet port 72 formed at the other side of the cabinet body 56 for allowing the outside air, which has exchanged heat with the circumferential surface of the tub 50, to be discharged out of the cabinet therethrough.

In the following description of the present embodiment, the inlet port 71 and the outlet port 72 are formed at the right or left side surface of the cabinet body 56 such that the inlet port 71 and the outlet port 72 are vertically spaced a predetermined distance from each other. Alternatively, the inlet port 71 and the outlet port 72 may be spaced from each other in an alternative configuration, such as, for example, the inlet port 71 and outlet port 72 may be horizontally as well as vertically spaced from each other.

The air-cooling type condensing unit 70 further includes: an introduction channel 73 for guiding the outside air introduced through the inlet port 71 into the tub 50; a condensing channel 74 for performing heat exchange between the outside air introduced into the tub 50 through the introduction channel 73 and the inner circumferential surface of the tub 50 to condense air used to dry the laundry 100; and a discharge channel 75 for guiding the heat-exchanged air such that the air is discharged out of the cabinet body 56 through the outlet port 72.

The introduction channel 73 is formed by a first channel guide 78 connected between the inlet port 71 and the circumferential surface of the tub 50, and the outlet channel 75 is formed by a second channel guide 79 connected between the outlet port 72 and the circumferential surface of the tub 50.

In the condensing channel 74 is mounted a condensing plate 77 for facilitating heat exchange between the outside air and the inner circumferential surface of the tub 50.

Preferably, the condensing plate 77 is spaced a predetermined distance from the inner circumferential surface of the tub 50 such that the outside air introduced into the tub 50 through the introduction channel 73 can flow along the inner wall of the tub 50.

As can be easily seen from the above description, the condensing channel 74 is defined by the condensing plate 77 and the inner circumferential surface of the tub 50.

The condensing plate 77 may be curved. Further, the condensing plate 77 may be curved such that the radius of curvature of condensing plate 77 substantially corresponds to the radius of curvature of the inner wall of the tub 50.

The condensing plate 77 may be made of a suitable material such as, for example, metal having high thermal conductivity. Additionally, the condensing plate may be embossed.

The condensing channel 74 is provided below the duct communication port 63. As shown in FIG. 3, the condensing channel 74 has a predetermined width extending between the rear side of the tub 50 and the front side of the tub 50 adjacent the duct communication port 63.

In the introduction channel 73 are mounted a blowing fan 76 and a motor (not shown), by which air flow is increased, and efficiency of heat exchange is improved through forced convection.

A drying process of the washing and drying machine with the above-stated construction according to the first embodiment of the present invention will now be described.

In the drying process for drying the laundry 100, the drum 51 is rotated, and the circulating fan 53, the drying heater 52, and the blowing fan 76 are turned on.

As the drum 51 is rotated, the laundry 100 is shaken and tossed in the drum 51. At this time air in the drum 51 flows toward the through-holes 64 of the drum 51 by blowing force generated when the circulating fan 53 is rotated.

The air flowing toward the through-holes 64 of the drum 51 comes into contact with the laundry 100. As a result, the laundry 100 is dried, and the air is changed into low-temperature and high-humidity air. The low-temperature and high-humidity air flows between the drum 51 and the tub 50 through the through-holes 64 of the drum 51.

The low-temperature and high-humidity air, i.e., the wet air, flowing between the drum 51 and the tub 50 comes into contact with the condensing channel 74. As a result, heat of the wet air is transmitted to the condensing plate 77.

At this time, outside air introduced through the inlet port 71 is guided into the condensing channel 74 through the introduction channel 73. The outside air guided into the condensing channel 73 absorbs heat from the condensing plate 77 and the inner wall of the tub 50, and is then discharged out of the cabinet body 56 through the outlet channel 65 and the outlet port 72.

Specifically, the outside air introduced through the inlet port 71 exchanges heat with the condensing plate 77 and the inner wall of the tub 50 to cool the condensing plate 77 and the inner wall of the tub 50, and the heat of the wet air is transmitted to the condensing plate 77. As a result, moisture contained in the wet air is condensed on the condensing plate 77, and therefore, the wet air is changed into low-humidity air.

The low-humidity air is introduced into the drying duct 54 through the introduction part 66 of the drying duct 54, and is then heated by the drying heater 52. As a result, the low-humidity air is changed into hot air.

The hot air is discharged into the tub 50 through the discharge part 67 of the drying duct 54 to dry the laundry 100 in the drum 51. The above-described procedure is repetitively carried out to continuously dry the laundry 100.

Meanwhile, the condensed water condensed on the surface of the condensing plate 77 falls along the condensing plate 77, and is then drained out of the cabinet through the drainage unit 62.

As can be easily understood from the above description, outside air is used to condense air used to dry the laundry 100. As a result, no cooling water is used to condense air used to dry the laundry 100. Consequently, consumption of water is reduced.

Furthermore, no condensing duct is necessary. Consequently, flow resistance is decreased. In addition, the structure of the channels, through which the outside air is introduced and discharged, is simple, and therefore, sufficient space is provided between the rear surface of the tub 50 and the cabinet body 56.

Figure 5:
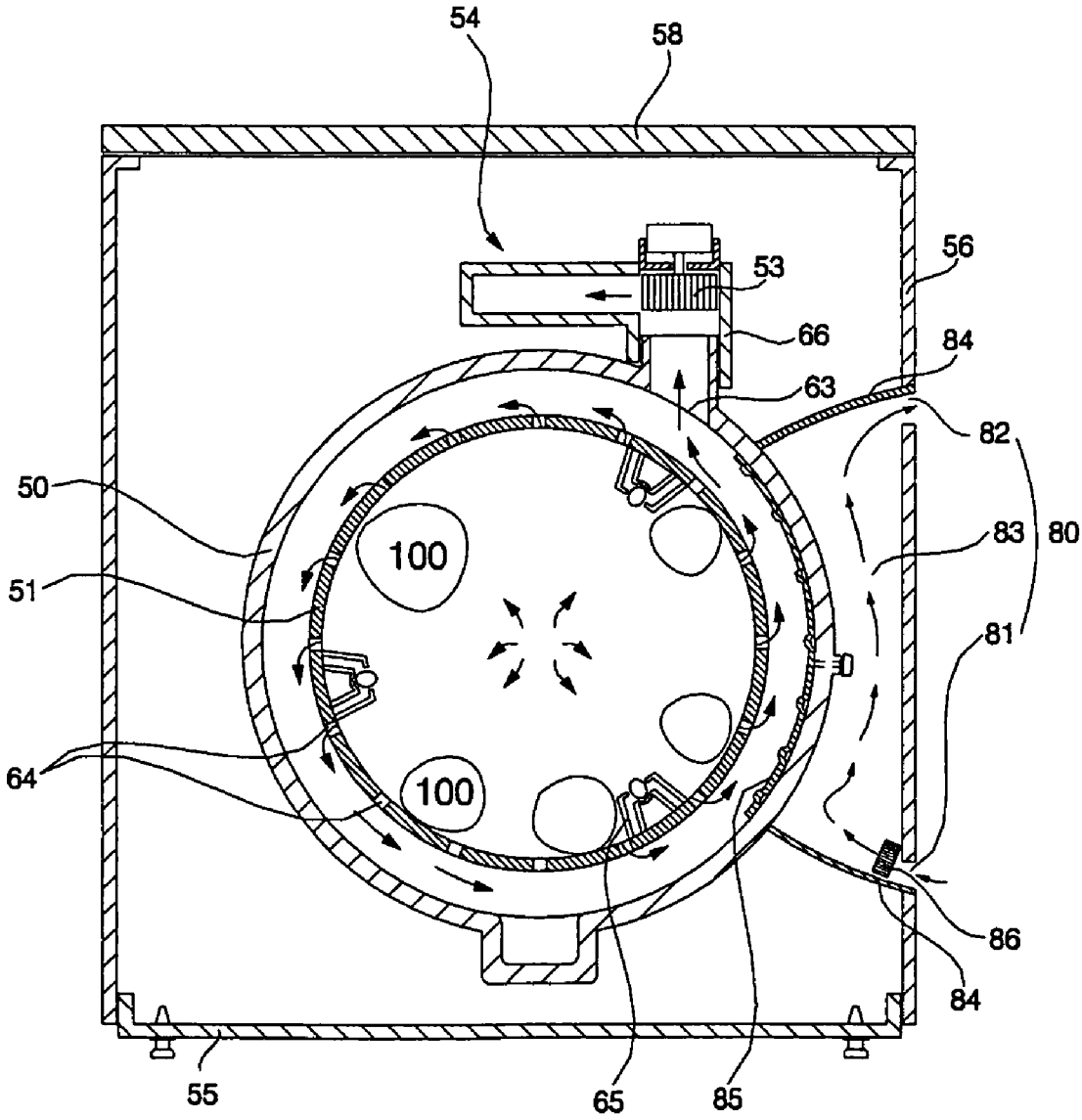
FIG. 5 is a cross-sectional view illustrating a washing and drying machine according to a second embodiment of the present invention.

FIG. 5 is a cross-sectional view illustrating a washing and drying machine according to a second embodiment of the present invention.

The washing and drying machine according to the second embodiment of the present invention includes an air-cooling type condensing unit 80. As shown in FIG. 5, the air-cooling type condensing unit 80 includes: an inlet port 81 formed at one side of the cabinet body 56 for allowing outside air to be introduced into the cabinet therethrough; an outlet port 82 formed at the other side of the cabinet body 56 for allowing the outside air, which has exchanged heat with the circumferential surface of the tub 50, to be discharged out of the cabinet therethrough; and a condensing channel 83 defined by the inside surface of the cabinet body 56 and the outer circumferential surface of the tub 50 for allowing the outside air introduced through the inlet port 81 to flow between the outer circumferential surface of the tub 50 and the inside surface of the cabinet body 56 and then guiding the air such that the air is discharged out of the cabinet body 56 through the outlet port 82.

Between the outer circumferential surface of the tub 50 and the inside surface of the cabinet body 56 is connected a third channel guide 84 for guiding the outside air such that the outside air makes partial contact with the outer circumferential surface of the tub 50. The condensing channel 83 is defined by the outer circumferential surface of the tub 50, the cabinet body 56, and the third channel guide 84.

Other components of the washing and drying machine according to the second embodiment of the present invention are identical in construction and operation to those of the washing and drying machine according to the first embodiment of the present invention. Therefore, the components of the washing and drying machine according to the second embodiment of the present invention, which are identical to those of the washing and drying machine according to the first embodiment of the present invention, are indicated by the same reference numerals as those of the washing and drying machine according to the first embodiment of the present invention, and a detailed description thereof will not be given.

At the inner or outer circumferential surface of the tub 50 may be mounted a condensing plate 85 for facilitating heat exchange between the outside air and the inner or outer circumferential surface of the tub 50. In the illustrated embodiment, the condensing plate 85 is tightly attached to the inner circumferential surface of the tub 50.

Also, a blowing fan 86 is mounted at the inlet port 81 such that the blowing fan 86 is perpendicular to the flow direction of the outside air.

In the washing and drying machine according to the second embodiment of the present invention, the channel is constructed such that the outside air does not flow into the inside of the tub 50, i.e., the outside air flows between the outer circumferential surface of the tub 50 and the inner wall of the cabinet. Consequently, the construction of the channel is simplified.

Figure 6:
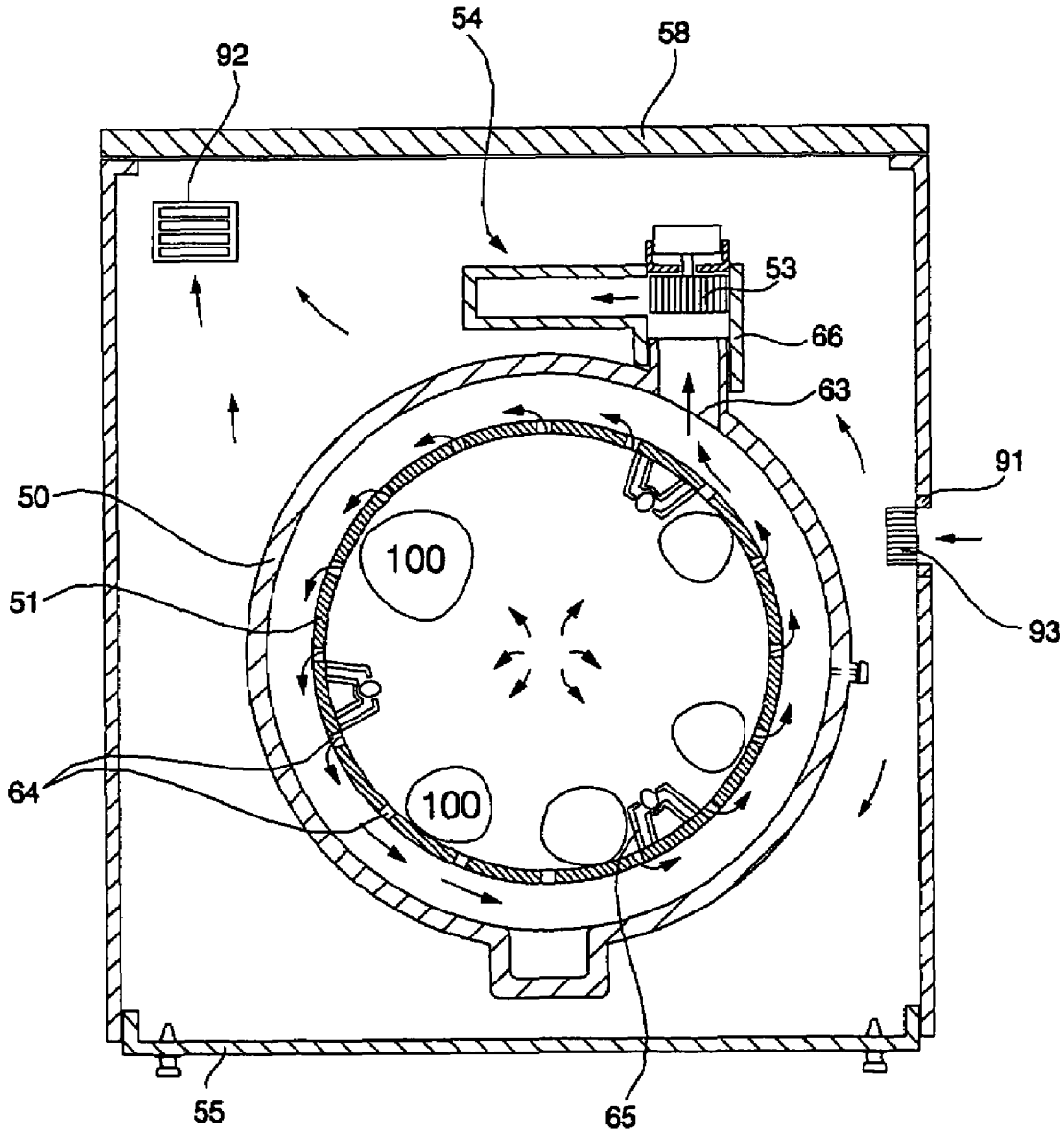
FIG. 6 is a cross-sectional view illustrating a washing and drying machine according to a third embodiment of the present invention.

FIG. 6 is a cross-sectional view illustrating a washing and drying machine according to a third embodiment of the present invention.

The washing and drying machine according to the third embodiment of the present invention includes an air-cooling type condensing unit. As shown in FIG. 6, the air-cooling type condensing unit includes: an inlet port 91 formed at one side of the cabinet body 56 for allowing outside air to be introduced into the cabinet therethrough; and an outlet port 92 formed at the other side of the cabinet body 56 for allowing the outside air, which has exchanged heat with the circumferential surface of the tub 50, to be discharged out of the cabinet therethrough.

In the illustrated embodiment, the inlet port 91 is formed on the right or left side surface of the cabinet body 56, and the outlet port 92 is formed on the rear surface of the cabinet body 56. Alternatively, the inlet port 91 may be formed on another surface of the cabinet body 56 such as the rear, top or front surface; and the outlet port 92 may be formed on a side, top or front surface.

The washing and drying machine according to the third embodiment of the present invention is identical in construction and operation to the washing and drying machine according to the first embodiment of the present invention except that the outside air introduced through the inlet port 91 exchanges heat with the entire outer circumferential surface of the tub 50, while passing through the cabinet, to condense air used to dry the laundry 100. Therefore, other components of the washing and drying machine according to the third embodiment of the present invention, which are identical in construction and operation to those of the washing and drying machine according to the first embodiment of the present invention, are indicated by the same reference numerals as those of the washing and drying machine according to the first embodiment of the present invention, and a detailed description thereof will not be given.

At the inlet port 91 is mounted a blowing fan 93 for increasing air flow and cooling the outer circumferential surface of the tub 50 through forced convection.

Another blowing fan may be mounted at the outlet port 92. In the illustrated embodiment, however, the blowing fan 93 is mounted only at the inlet port 91.

As apparent from the above description, the washing and drying machine according to the present invention has the following effects.

The outside air exchanges heat with the circumferential surface of the tub to condense air used to dry the laundry. As a result, no cooling water is used to condense air used to dry the laundry. Consequently, the present invention has the effect of reducing consumption of water, and therefore, decreasing the maintenance costs of the washing and drying machine.

Furthermore, no condensing duct is necessary. Consequently, flow resistance is decreased, and therefore, drying efficiency is improved. In addition, sufficient space is provided between the rear surface of the tub and the cabinet. Consequently, the present invention has the effect of increasing the volume of the drum, and therefore, increasing the washing/drying capacity of the washing and drying machine.

Although the present invention has been described with reference to exemplary embodiments, it is understood that the words that have been used are words of description and illustration, rather than words of limitation. Changes may be made within the purview of the appended claims, as presently stated and as amended, without departing from the scope and spirit of the invention and in its aspects. Although the invention has been described with reference to particular means, materials and embodiments, the invention is not intended to be limited to the particulars disclosed. Rather, the invention extends to all functionally equivalent structures, methods and uses such as are within the scope of the appended claims.

What is claimed is:

1. A washing and drying machine comprising:

a tub provided in a cabinet in a suspended manner;

a drum rotatably provided inside said tub;

a drying duct, having a drying heater and a circulating fan, said drying duct supplying hot air into said drum to dry laundry; and an air-cooling condensing unit that performs heat exchange between outside air introduced from the outside of the cabinet and circulated air to dry laundry such that water is condensed from the circulated air, wherein said air-cooling condensing unit comprises:

an inlet port formed in the cabinet;

an introduction channel that guides the outside air introduced through said inlet port into said tub;

a condensing channel formed between the drum and the tub for condensing water from the circulated air;

a condensing plate mounted in the condensing channel to perform heat exchange between the outside air introduced into the condensing channel and the circulated air;

an outlet port formed in the cabinet; and a discharge channel that guides the heat-exchanged outside air to be discharged out of the cabinet through said outlet port.

2. The machine as set forth in claim 1, wherein said inlet port and said outlet port are provided on one side of the cabinet such that said inlet port and said outlet port are vertically spaced a predetermined distance from each other.

3. The machine as set forth in claim 1, wherein said condensing plate is spaced a predetermined distance from the inner circumferential surface of said tub such that the outside air can flow along the inner wall of said tub.

4. The machine as set forth in claim 1, wherein said condensing plate is made of metal.

5. The machine as set forth in claim 1, wherein said condensing plate is embossed.

6. The machine as set forth in claim 1, wherein said air-cooling type condensing unit further comprises:

a blowing fan mounted in said introduction channel.

7. The machine as set forth in claim 1, further comprising:

a duct communication port formed at a circumferential surface of said tub such that an inlet end of said drying duct is connected to said duct communication port, wherein said condensing channel is provided below said duct communication port.

8. The machine as set forth in claim 1, wherein the condensing plate is between the drum and the tub.

9. The machine as set forth in claim 1, wherein the introduction channel has an outlet in the condensing channel.

10. The machine as set forth in claim 1, wherein the condensing plate is joined to the tub to separate the outside air from the circulated air between the tub and the drum.

11. The machine as set forth in claim 1, wherein the drying duct, the discharge channel and the introduction channel each extend from the opening in the tub.

* * * * *